US005115857A

United States Patent [19]

Schertler et al.

[11] Patent Number: 5,115,857

[45] Date of Patent: May 26, 1992

[54] STRAND GUIDE ARRANGEMENT PROVIDED AT A CONTINUOUS CASTING PLANT

[75] Inventors: Armin Schertler, Guntramsdorf; Josef A. Ortner, Hörsching; Werner Scheurecker, Linz; Kurt Engel, St. Florian, all of Austria

[73] Assignee: Voest-Alpine Industrieanlagenbau G.m.b.H., Linz, Austria

[21] Appl. No.: 726,348

[22] Filed: Jul. 5, 1991

[30] Foreign Application Priority Data

Jul. 18, 1990 [DE] Fed. Rep. of Germany ..... 4022871
Jul. 18, 1990 [DE] Fed. Rep. of Germany ..... 4022894

[51] Int. Cl.[5] ..... B22D 11/128
[52] U.S. Cl. ..... 164/448; 164/442
[58] Field of Search ..... 164/448, 442

[56] References Cited

U.S. PATENT DOCUMENTS 4,007,822 2/1977 Scheurecker ..... 164/448
4,046,188 9/1977 Kagerhuber et al. ..... 164/448
4,076,069 2/1978 Scheinecker et al. ..... 164/448
4,122,888 10/1978 Pühringer ..... 164/448 X
4,146,083 3/1979 Scheurecker et al. ..... 164/448
4,362,206 12/1982 Cordella et al. ..... 164/448
4,432,407 2/1984 Scheurecker et al. ..... 164/448
4,479,529 10/1984 Scheurecker ..... 164/448 X

FOREIGN PATENT DOCUMENTS 3829549 3/1990 Fed. Rep. of Germany ..... 164/442

*Primary Examiner*—J. Reed Batten, Jr.
*Attorney, Agent, or Firm*—Hopgood, Calimafde, Kalil, Blaustein & Judlowe

[57] ABSTRACT

With known strand guides, the adjustment of different strand thicknesses involves cumbersome manipulations and the susceptibility to failures of the elements allowing for such adjustment. In order to eliminate such disadvantages, the framework parts of the strand guide rest one above the other by supports and counter supports equipped with supporting surfaces provided at different high levels and with counter supporting surfaces, respectively. In addition to the support and counter support, a rotary bushing having a helicoidal supporting surface is arranged in series to each support and counter support. An abutment allocated to one of the framework parts is supported on the rotary bushing.

24 Claims, 7 Drawing Sheets

VII 9
62
23
14
7
18
17
10
8
13
3
2
5
11
6
12
10
3
2
4
5
3
2
10
78
61
76
17
25
1
5
62
80
22
63
55
77
57
83
78
56
VII
58
66
71
59
60
23
24
21
20

STRAND GUIDE ARRANGEMENT PROVIDED AT A CONTINUOUS CASTING PLANT

The invention relates to a strand guide provided at a continuous casting plant and comprising framework parts carrying oppositely located strand guiding rollers, at least one of which framework parts is displaceable along a guiding means by a displacement means while widening or narrowing the distance of the oppositely located strand guiding rollers, wherein the framework parts are clampable relative to each other by the displacement means until abutment of supporting means on counter supporting means equipped with supporting surfaces provided at different height levels and with counter supporting surfaces, respectively.

A strand guide of this type is known from DE-C 1 963 146. There, the supporting means is designed as a bushing having supporting surfaces stepwisely provided at different height levels. The bushing is rotatable about its axis in a manner that one supporting surface each is able to get into contact with a counter supporting surface of a counter supporting means, the supporting means, thus, being placeable at different distances relative to the counter supporting means and different distances of the oppositely located strand guiding rollers, thus, being fixable.

However, it is disadvantageous that only predetermined strand thicknesses can be cast, the number of different strand thicknesses being dependent on the number of supporting and counter supporting surfaces.

Furthermore, it is disadvantageous that no precise adaptation to the desired strand format is feasible with the known strand guide; in particular, it is not possible to vary the distances of the oppositely located rollers of the strand guide according to the shrinkage of the strand over the length of the strand guide, i.e., to arrange the oppositely located rollerways of the strand guides in a wedge-like manner over the longitudinal extension of the strand guide.

From EP-B1 0 194 656, a strand guide is known in which the step-wise adjustment of the distance of oppositely located rollerways is feasible by aid of exchangeable shims and the precise adjustment is feasible by aid of rotary spindles each mounted on one of the framework parts by means of a thread and capable of being eccentrically slipped and supported on a shim by its front face. Replacement of the shims is cumbersome and time-consuming. Besides, the drive of the spindles calls for a complex structure. Moreover, a high surface pressure results between the front face of the spindle and the shim. Due to the eccentric seat of the spindles on the shims, bending moments will occur in the framework parts.

The invention aims at avoiding these disadvantages and difficulties and has as its object to provide a strand guide of the initally defined kind, in which the roller distances of oppositely located strand guiding rollers are arbitrarily adjustable in a manner that one may speak of a practically continuous adjustability of the roller distance.

Nevertheless, the strand guide is to be of a construction simple to produce and easy to maintain, which is hardly susceptible to repair despite the rough strand casting operation.

Furthermore, any repair or exchange of the roller distance adjustment mechanism is to be feasible within a short period of time.

In accordance with the invention, this object is achieved in that a rotary bushing having a helicoidal supporting surface is arranged in series to each supporting and counter supporting means between the framework parts, on which bushing an abutment allocated to one of the framework parts is supported.

Advantageously, also the abutment is formed by a bushing having a helicoidal supporting surface, which bushing is irrotational and abuts against the supporting surface of the rotary bushing by its supporting surface.

A particularly simple mode of construction is characterized in that the supporting and counter supporting means, the rotary bushing as well as the abutment are each arranged centrically with respect to a tension rod connecting the opposite framework parts, the framework parts, seen from above, advantageously being designed as rectangular frames in whose corners one tension rod is each arranged.

Suitably, the tension rods are each designed as a pressure medium cylinder, whose cylinder is articulately connected to one of the framework parts an whose piston rod is articulately connected to the opposite framework part, the supporting and counter supporting surfaces being passed through by the piston rods of the pressure medium cylinders.

It is advantageous, in particular, for adjusting a roller gap that is conical over the longitudinal extension of the strand guide, to provide a guiding means on one of the framework parts, on which guiding means the other framework part is guided laterally, i.e., perpendicularly to the moving direction, the guiding means yet allowing for pivotal movements of the framework parts relative to each other about an axis extending parallel to that of the rollers.

A preferred embodiment of the invention is characterized in that the guiding means is formed by a guiding column that is rigidly arranged on one of the framework parts, laterally projecting cambered supporting surfaces being provided on the guiding column and contacting guiding surfaces of the second framework part, the cambered supporting surfaces advantageously being cylindrical.

For the easy adjustment of a roller gap that is conical in the longitudinal direction of the strand guide, the rotary bushings provided on the pressure medium cylinders arranged in equal positions in the longitudinal direction of the strand guide advantageously are actuatable synchronously and independently of the rotary bushings provided on the pressure medium cylinders arranged in other positions in the longitudinal direction of the strand guide.

A preferred embodiment is characterized in that the supporting and counter supporting means are designed as discs or bushes surrounding the piston rods of the pressure medium cylinders, one of the supporting or counter supporting means is each rotatable relative to the piston rod of a pressure medium cylinder, one supporting or counter supporting means is each provided with projections, and one supporting or counter supporting means is each provided with recesses receiving the projections, which projections, by rotating the supporting or counter supporting means, are insertable into the recesses or are placeable on projections provided between the recesses.

A wide rang of adjustment of the roller distances may be achieved despite the use of a rotary bushing including a helicoidal supporting surface having a slight inclination, by providing projections or recesses on several height levels for each supporting or counter supporting means.

When providing two or more counter supporting means per tension rod, a particularly wide range of different roller distances will be attained even with a slight angle of rotation of the bushing having a helicoidal supporting surface.

Simple maintenance and easy exchange of the arrangement for adjusting a roller distance will be ensured if a supporting and counter supporting means each, together with a rotary bushing and its abutment, forms a structural unit to be slipped on a tension rod.

In order to protect the arrangement from splash water and dirt, each structural unit advantageously is externally surrounded by a protective arrangement designed as a telescopic cylinder.

To relieve, during continuous casting, the means rotating the bushing having a helicoidal supporting surface, the helicoidal supporting surface of the rotary bushing suitably has an angle of inclination that is smaller than the angle of friction pertaining to the friction prevailing between itself and the abutment.

According to another object of the invention, there is to be provided a strand guide with which the adjusting procedure for adjustment of the distance of the oppositely located strand guiding rollers is to be feasible in a particularly simple way and with which relatively large supporting and counter supporting surfaces are available despite the narrow spacial conditions and the very small configuration of the supporting and counter supporting means. In addition, the adjustment means for adjusting the supporting and counter supporting surfaces is to be kept as small as desired.

According to a preferred embodiment, this object is achieved in that the supporting and counter supporting means are designed as supporting and counter supporting discs alignedly superimposed in the direction of their central axes and oriented parallel to the guiding means with their central axes, on each side of the framework parts, that is allocated to one end of the strand guiding rollers at least two superimposed concentric supporting discs and a single counter supporting disc are arranged, the supporting discs each are provided with recesses disposed centrically with respect to their central axes, each counter supporting disc is provided with projections extending in the direction of their central axes and capable of being introduced into the recesses of the supporting discs, the lengths of the projections being dimensioned to be larger than the thickness of the supporting disc(s) located above the lowermost supporting dics, and the supporting discs are rotatable by adjustment means about their central axes at a predetermined angle into a position in which the recesses of the superimposed supporting discs register with the projections of the counter supporting discs as well as into a position in which the recesses of one or several supporting discs come to lie laterally of the projections.

Since each supporting disc need be rotated into two positions only, a pressure-medium cylinder of the most simple design may be provided as a rotation drive for each supporting disc. Approximately half of the annular surface occupied by the supporting and counter supporting discs is available both as the supporting and counter supporting surfaces for absorbing the clamping force pressing the framework parts against each other. Since the cross sectional areas of the recesses of each supporting disc and the cross sectional areas of the projections of the counter supporting discs may be chosen as small as desired—at least in respect of their peripheral dimensions—, a relatively small angular movement of the supporting discs will do to change the distance of the oppositely located strand guiding rollers. In other words, this means that even the driving means for realizing the rotational movement of the supporting discs may be kept small.

To optimumly utilize the surface area, the recesses of the supporting discs advantageously are designed as segment-shaped holes and the projections of the counter supporting discs have corresponding cross sections reduced by a lateral play.

In order to be able to obtain as high a number as possible of gradations of the distances of the oppositely located strand guiding rollers at as little expenditures as possible, the lengths of the projections of the counter supporting discs advantageously are dimensioned to be larger by a play than the sum of the thicknesses of the registering supporting discs arranged in a stack.

To provide for the guidance of the supporting discs and to safeguard their exact rotated position, guide ledges suitably are provided on the external circumference of the supporting discs parallel to the central axes of the supporting discs, extending over the height of the supporting discs registering in a stack, and the supporting discs include stops for limiting their rotational movements, which stops cooperate with the guide ledges.

Preferably, pressure medium cylinders are provided for rotating the supporting discs, i.e., a separate pressure medium cylinder for each of the superimposed supporting discs.

In order to prevent impurities from penetrating between the supporting discs, the supporting discs, according to a preferred embodiment, are each provided with an annular groove on their external sides, into which there projects a peripheral web of the supporting disc arranged thereabove or therebelow.

For the purpose of securing the position of the supporting discs, the guide ledges, on their ends facing the uppermost supporting disc, advantageously are connected with a peripheral annular bead overlapping the uppermost supporting disc.

Preferably, the supporting and counter supporting discs each are arranged centrically with respect to a tension rod connecting the opposite framework parts.

In order to ensure the projections of the counter supporting discs to each abut on sandwiched solid material of the supporting discs, a control valve suitably is provided to control the pressure medium cylinders of the stacked supporting discs in a manner that the projections of the counter supporting discs each abut on sandwiched solid material of the supporting discs.

The invention will be explained in more detail by way of several exemplary embodiments with reference to the accompanying drawings, wherein.

Figure 5:
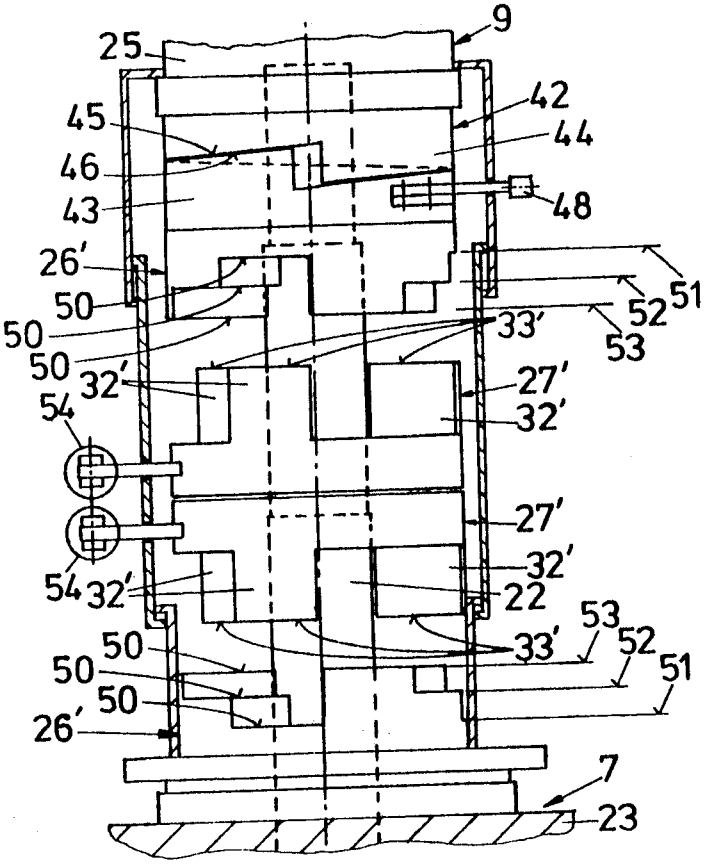
Figure 4:
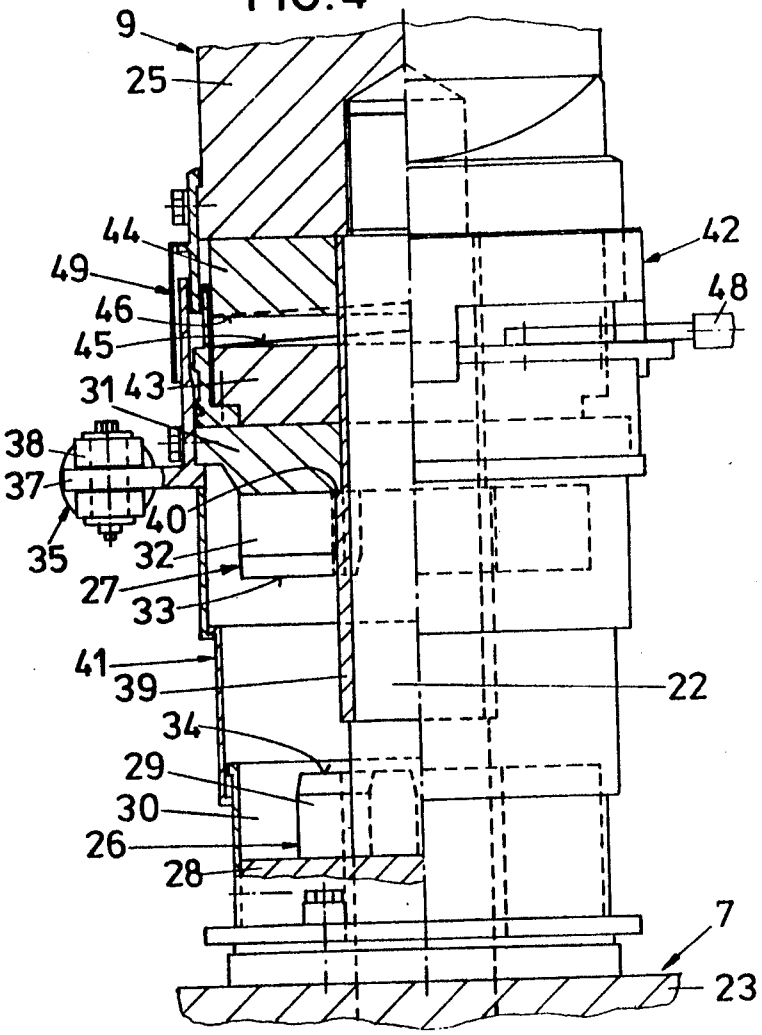
FIG. 4 represents a detail of FIG. 1 on an enlarged scale, viewed partially elevated and partially sectioned.
Figure 6:
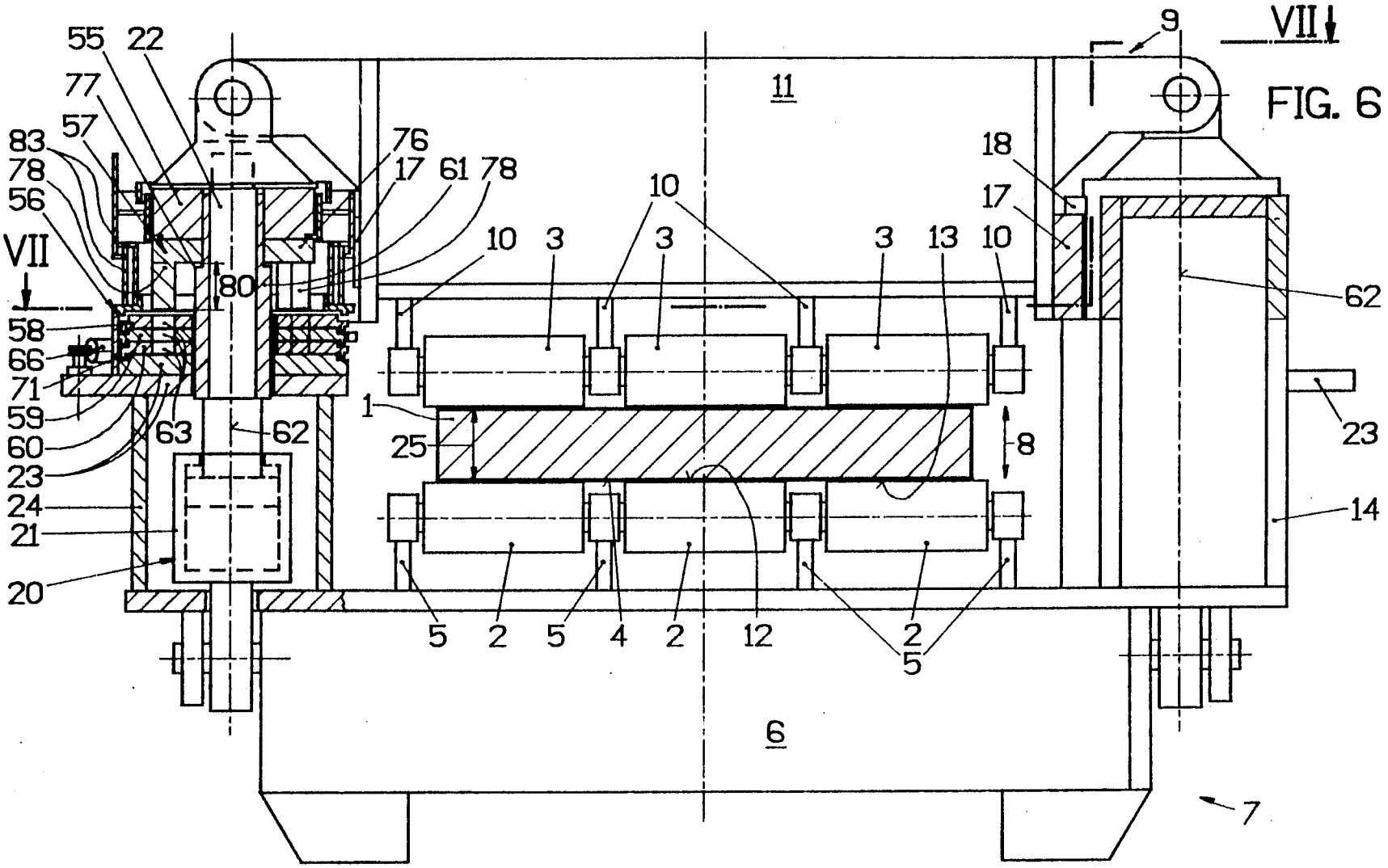
Figure 7:
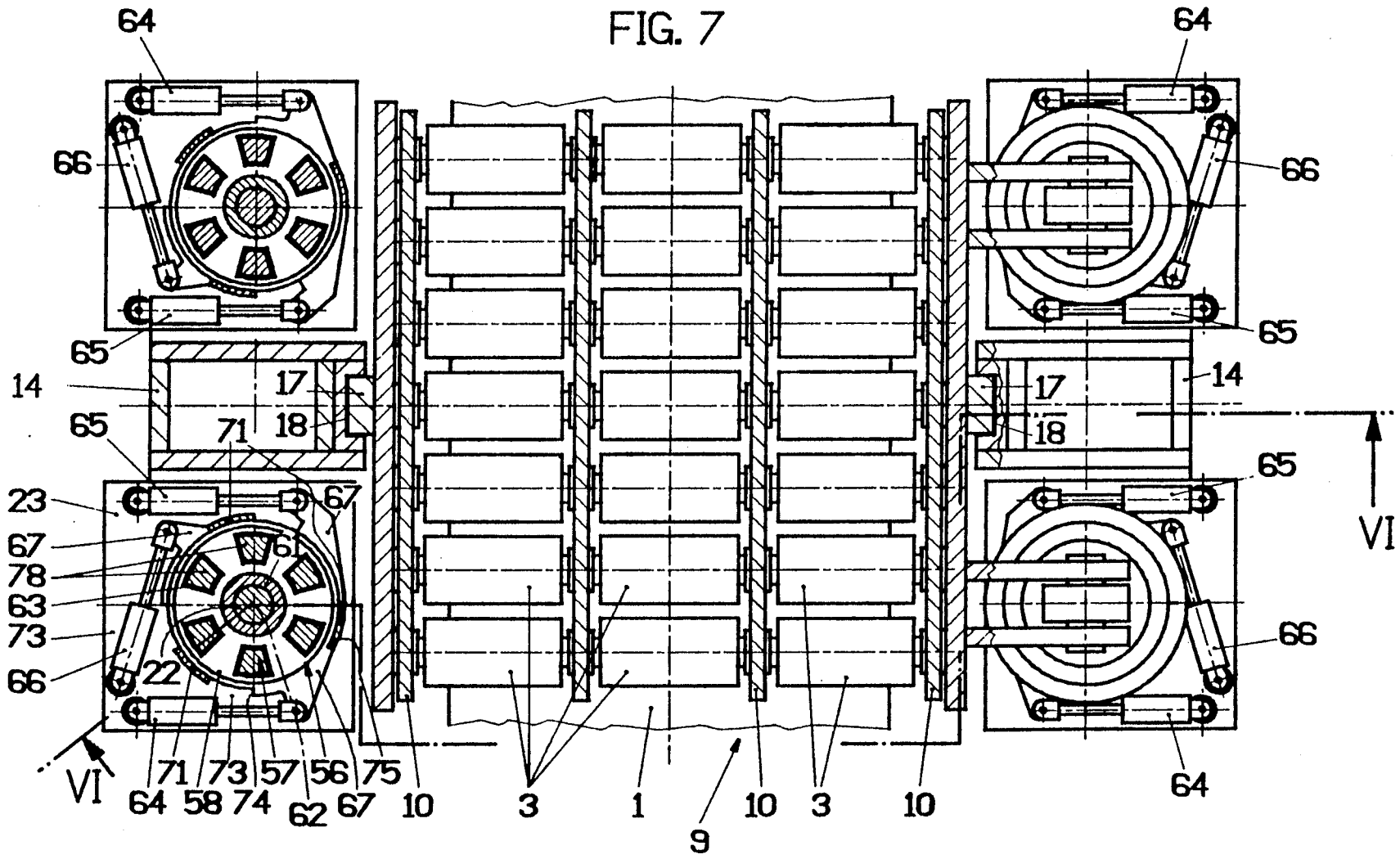
Figure 8:
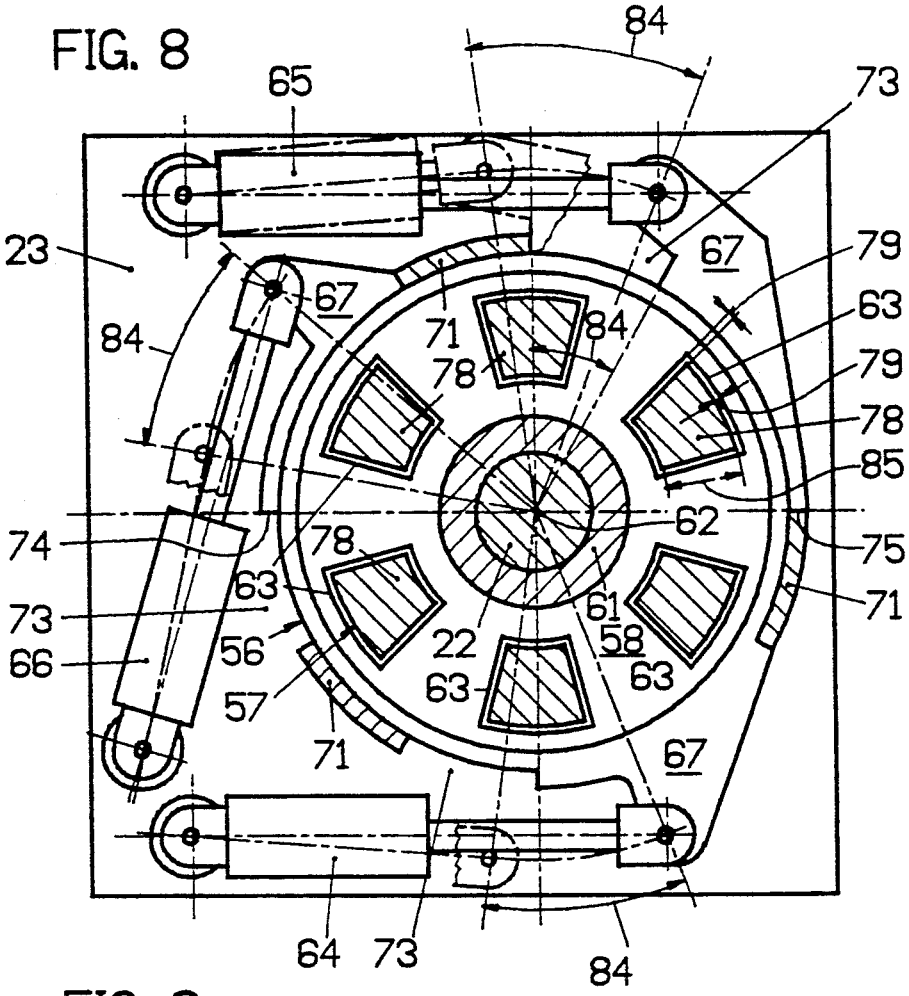
Figure 9:
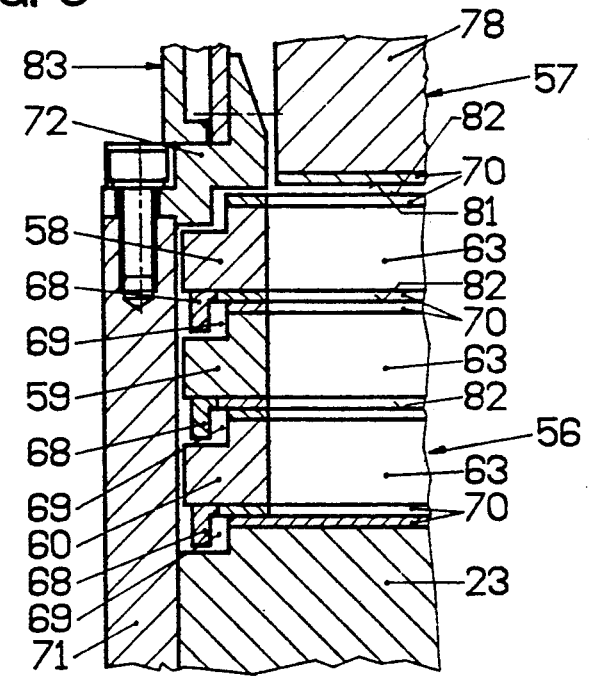
Figure 10:
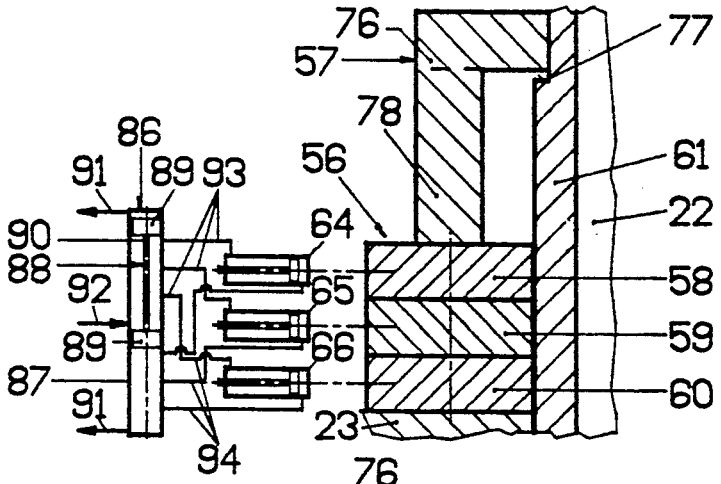
Figure 11:
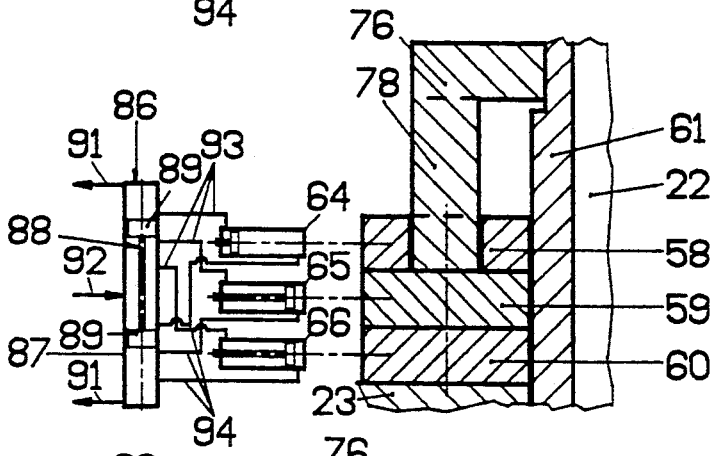
Figure 12:
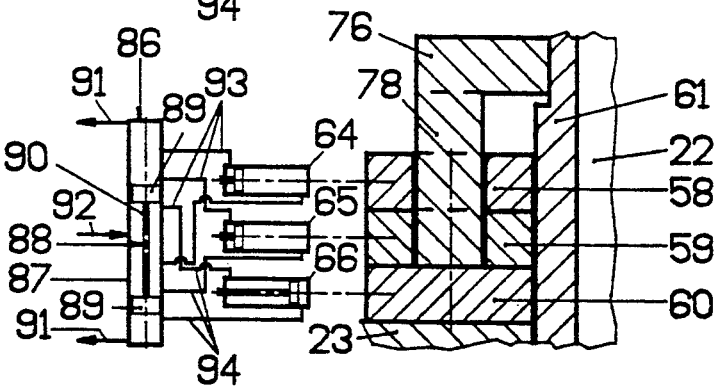
Figure 13:
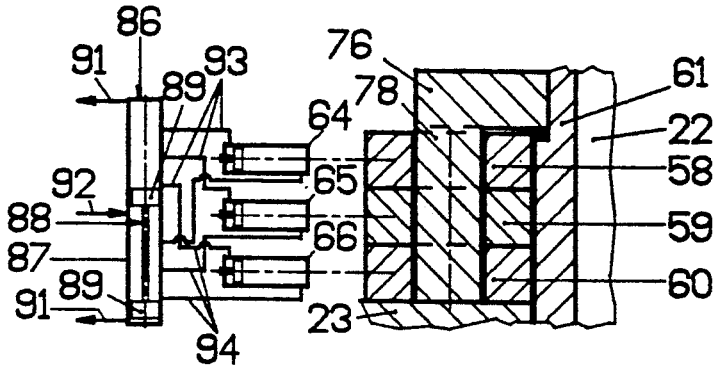

FIG. 5 schematically illustrates a second embodiment in a manner analogous to FIG. 4;

FIG. 6 is a partially sectioned side view of a strand guiding stand according to a further embodiment in the direction of the strand axis, taken along line VI—VI in FIG. 7;

FIG. 7 is a partially sectioned top view on this strand guiding stand taken along line VII—VII in FIG. 6;

FIG. 8 represents a detail of FIG. 7 on an enlarged scale;

FIG. 9 represents a detail of FIG. 6 on an enlarged scale;

FIGS. 10, 11, 12 and 13 schematically illustrate a control means for the strand guiding stand and its mode of functioning, FIGS. 10 to 13 each corresponding to differently adjusted distances of the oppositely located strand guiding rollers.

A strand 1 having slab cross section—it could also be a strand having billet or bloom cross section—is guided and supported between two oppositely located strand guiding rollers 2, 3.

The strand guiding rollers 2 supporting the strand 1 on its external or lower side 4, via longitudinal carriers 5, are journalled on two cross beams 6 supported on the base. The stationary framework part 7, which is comprised of longitudinal carriers 5 and cross beams 6, is opposed by a framework part 9 that is displaceable in the direction of the thickness 8 and, thus, the roller distance of the rollers 2 and 3, of the strand 1, which framework part 9 also is comprised of longitudinal carriers 10 and cross beams 11. The framework part 9, which is displaceable relative to the stationary framework part 7, is guided on guiding columns 14 rigidly mounted to the stationary framework part 7 laterally of the strand guideways 12, 13 formed by the strand guiding rollers 2 and 3, in the longitudinal direction of the strand guideways, via two camferedly, preferably cylindrically, shaped supporting surfaces 15 provided on each of the guiding columns 14 on the same level, yet on opposite sides of the guiding column 14, on which supporting surfaces there rest side cheeks including guiding surfaces 16 rigidly arranged on the displaceable framework part 9.

These cylindrical supporting surfaces 15 each have a radius R corresponding to half of their distance, the displaceable framework part 9, thus, being pivotable relative to the stationary framework part 7 about the common axis A of these supporting surfaces 15, which axis A extends parallel to the rollers 2, 3.

Guide ledges 17 are arranged on each stationary guiding column 14 in a manner transverse to the longitudinal direction of the strand guideways 12, 13 so as to project into a groove-shaped recess 18 of the displaceable framework part 9 with lateral play 19.

The framework parts 7, 9, which are rectangular in ground plan, are connected with each other at the corners by one pressure medium cylinder 20 each and are adjustable and clampable relative to each other by aid of these pressure medium cylinders.

Figure 1:
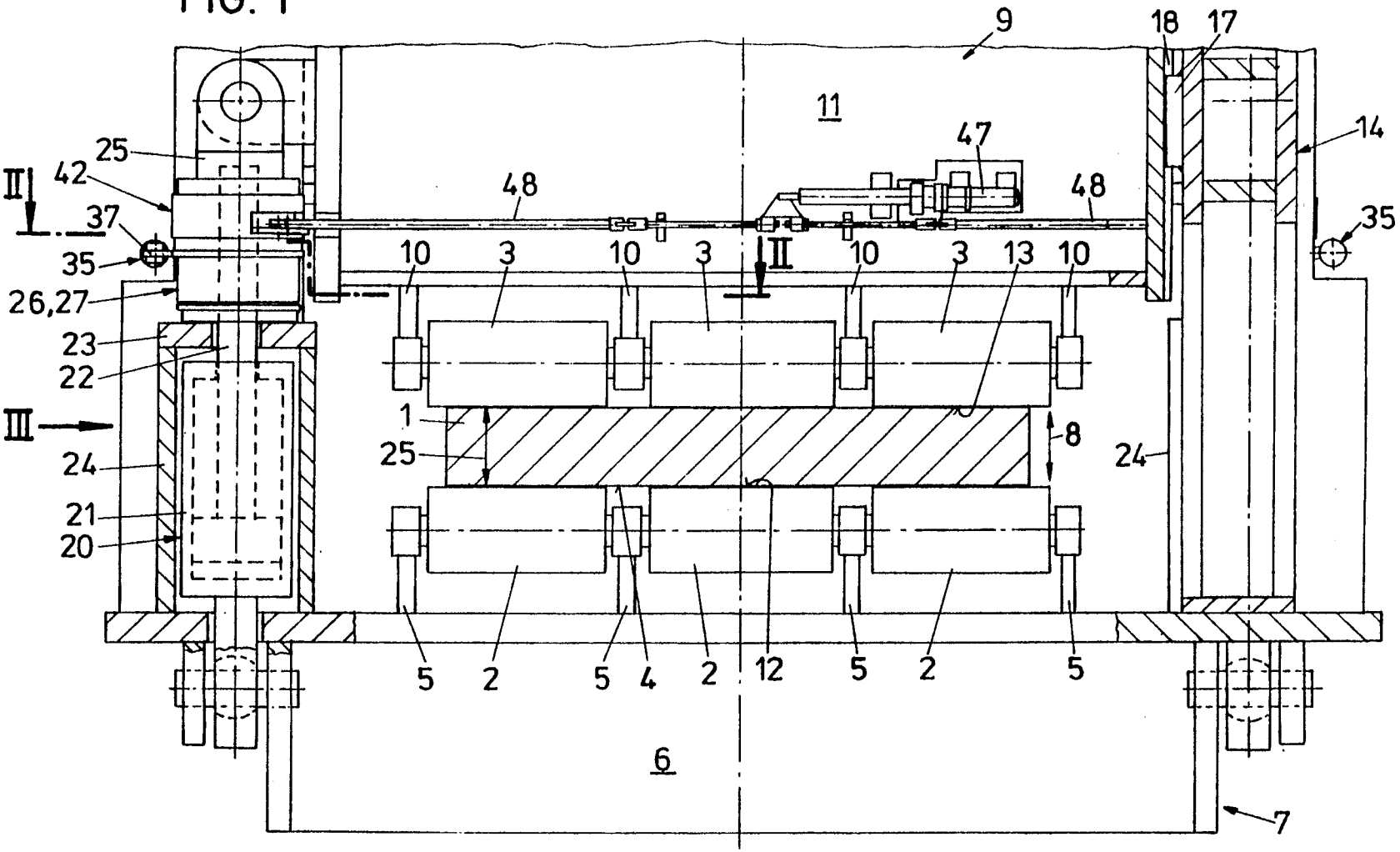
FIG. 1 is a partially sectioned side view of the strand guiding stand according to the invention in the direction of the strand axis.
Figure 2:
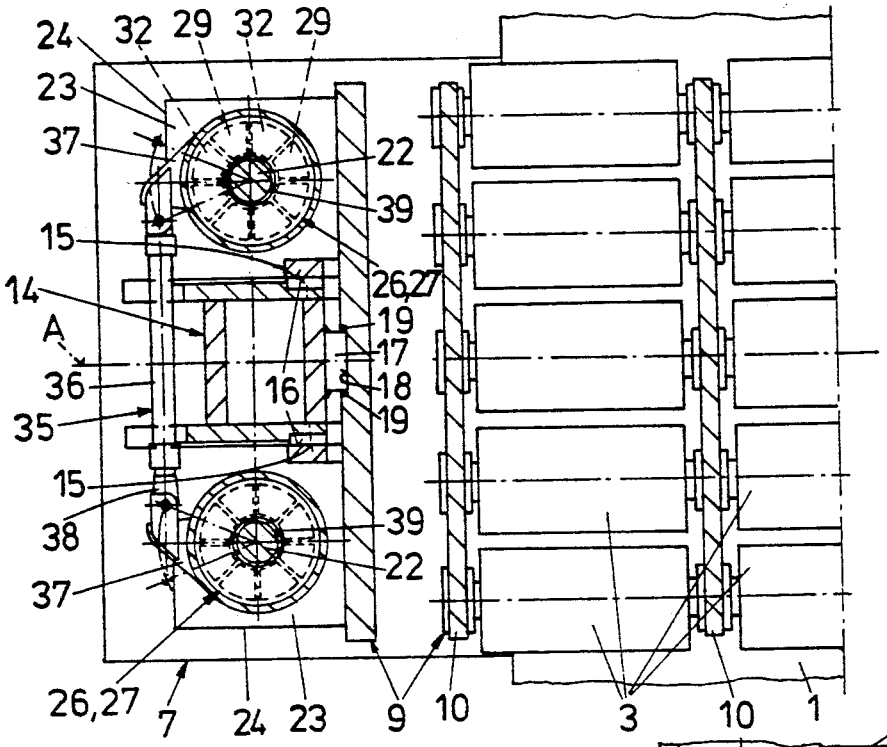
FIG. 2 is a top view on this strand guiding stand partially sectioned along line II—II of FIG. 1.
Figure 3:
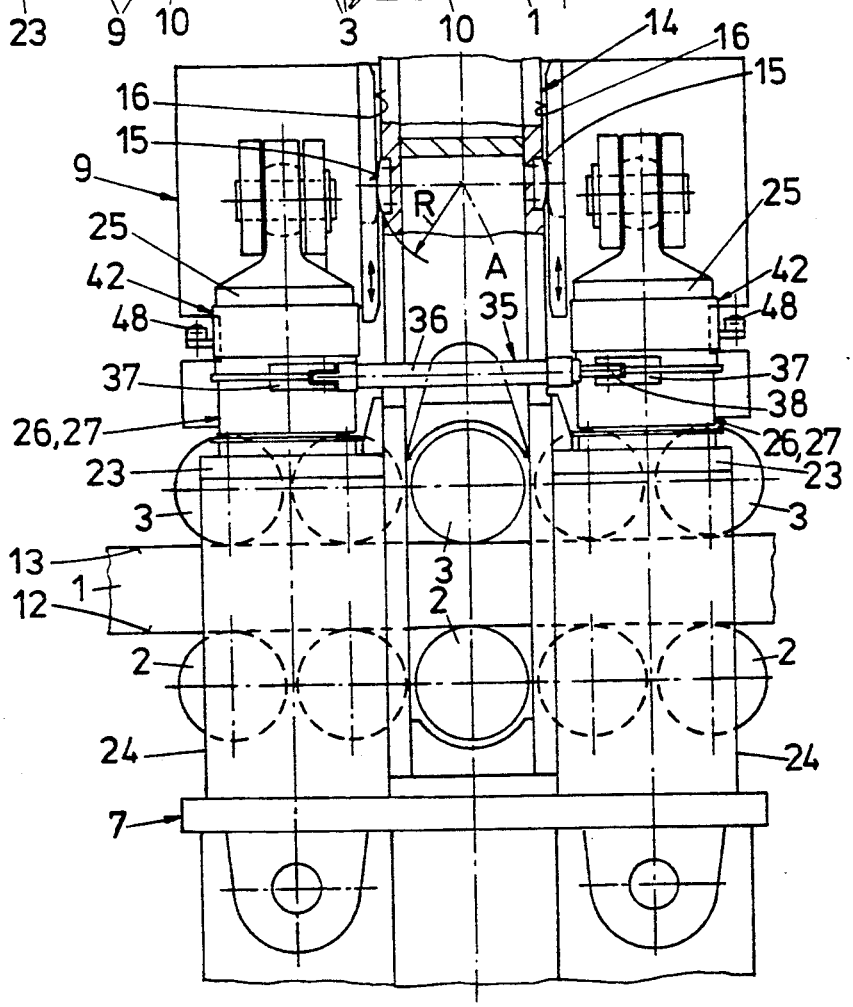
FIG. 3 is a side view in the direction of arrow III of FIG. 1.

As is apparent, in particular, from FIG. 1, the cylinder portions 21 of the pressure medium cylinders 20 are hinged to the stationary framework part 7 and the piston rods 22 are hinged to the displaceable framework part 9 via spherical bearings each. The articulation of the piston rods 22 to the displaceable framework part 9 is provided in the region of the axis A in terms of height.

Between the cover plate 23 of a housing 24 enclosing the cylinder portion 21 of a pressure medium cylinder 20 and a plate 25 arranged opposite this cover plate 23 and articulately connected to the end of the piston rod 22 or to the displaceable framework part 9, a supporting means 26 and a counter supporting means 27 are each arranged which enable the displaceable framework part 9 to be positioned at precisely defined distances relative to the stationary framework part 7 such that the distance of the oppositely located strand guideways 12, 13 and, thus, the thickness of the strand 1 to be cast are stepwisely variable. This is going to be explained in more detail in the following with reference to FIG. 4, which illustrates the individual parts of the arrangement 26, 27 in the separated position.

Each supporting means 26 is formed by an annular bushing 28 arranged concentrically about the piston rod and stationarily mounted to the cover plate 23, which bushing, on its side facing the counter supporting means 27, is provided with sector-shaped projections 29 directed towards the counter supporting means 27 and uniformly distributed about the circumference. Sector-shaped interstices or recesses 30, which are slightly larger than the projections 29, are provided between the projections 29.

The counter supporting means 27 also are formed by bushings 31 arranged concentrically with the piston rods 22 and configured in a manner diametrically opposed to the supporting means 26, i.e., provided with projections 32 facing the supporting means 26, which projections are insertable into the recesses 30 of the supporting means 26 between the projections 29 until the front faces 33 of the projections 32 contact the bottoms of the recesses 30 or are slippable on the front faces 34 of the projections 29 of the supporting means 26 by their front faces 33.

To this end, the counter supporting means 27 are rotatable about the piston rods 22, two counter supporting means 27 each, which are arranged on one side of the strand guideways 12, 13, being rotatable by a common pressure-medium cylinder 35, whose housing 36 is hinged to a projection 37 of one of the counter supporting means 27 and whose piston rod 38 is hinged to a projection 37 of the second counter supporting means 27. Stops (not illustrated) care for appropriate end positions of the rotational movements of the counter supporting means 27 in a manner that the projections 29, 32 of the supporting and counter supporting means 26, 27 will be located exactly opposite each other in a first rotated position and the projections 32 of the counter supporting means 27 will come to lie exactly between the projections 29 of the supporting means 26 in a second rotated position, two different distances 8, thus, being adjustable between the rollers 2 and 3.

The counter supporting means 27 each are arranged at a stepped bushing 39 slipped on the piston rod 22 of the pressure-medium cylinder 20 and movable therewith, and are supported on a step 40 of this stepped bushing 39. When extending the piston rod 22, the counter supporting means 27 is lifted off the supporting means 26 as illustrated in FIG. 4. The supporting means 26 and the counter supporting means 27 each are protected by an externally arranged telescopic cylinder 41.

A means 42 for finely adjusting the roller distance 8 of the oppositely located rollerways 12, 13 is arranged between the counter supporting means 27 and the end of the piston rod 22, i.e., of plate 25, which means 42, thus, is provided in series to each supporting means 26 and counter supporting means 27. The means 42 allow for the height adjustment of the displaceable framework part 9 relative to the stationary framework part 7 to an extent approximately corresponding to the height of the projections 29, 32 of the supporting 26 and counter supporting means 26, 27 or even slighter.

The means 42 are each comprised of two bushings 43, 44 contacting each other by corresponding helicoidal sliding surfaces 45, 46. One of the bushings 43, 44 is mounted stationary, i.e., irrotational, relative to the piston rod 22 of the pressure-medium cylinder 20. The second, opposite bushing 43 is rotational about the piston rod by aid of an adjustment device 47 allowing for the adjustment of a predetermined angle of rotation, such as, for instance, an electric adjustment device (Raco device), wherein two bushings 43 each arranged in equal positions of the longitudinal extension of the strand guideways 12, 13 and having helicoidal sliding surfaces 45 are commonly rotational by an adjustment device 47 via connecting rods 48.

Thereby, the displaceable framework part 9 can be pivoted about the axis A of the camfered supporting surfaces 15. Thus, it is possible to translate the displaceable framework part 9 by aid of the means 42 not only almost continuously parallel to itself—according to the minimum adjustment step of the Raco device and height difference resulting from the angle of inclination of the helicoidal supporting surface 45—, but also to wedgedly adjust the rollerway 13 constituted by the rollers of the displaceable framework part relative to the opposite rollerway 12 constituted by the rollers 2 on the rigidly arranged framework part 7 so that the shrinkage of the strand 1 in terms of thickness may be taken into account.

The two bushings 43, 44 having helicoidal sliding surfaces 45, 46 also are externally surrounded by a telescopic cylinder 49 in order to prevent the penetration of impurities between the bushings 43, 44.

The angle of inclination of the helicoidal sliding surfaces 45, 46 preferably is smaller than the pertaining angle of friction such that the adjustment device 47 will not be actuated by forces derived from the strand 1 or from the pressure medium cylinder 20. Instead of the irrotationally arranged bushing 44, an abutment of any other configuration may be provided, on which the helicoidal supporting surface 45 is supported.

Each supporting and counter supporting means, 26, 27 together with the pertaining device 42 arranged in series, is combined to a structural unit that is readily removable from, and slippable on, the piston rod 22 of the pressure medium cylinder 20 as a whole, thus offering easy repair or maintenance and service conditions.

According to the embodiment illustrated in FIG. 5, supporting means 26' and counter supporting means 27' are provided in duplicate on each pressure-medium cylinder 20 consecutively in series. The supporting means 26' has counter supporting surfaces 50 on three different levels 51, 52, 53, on which the front faces 33' of the projections 32' of the counter supporting means 27' constituting the supporting surfaces may facultatively be supported. In this case, the adjustment means 54 provided for rotating the counter supporting means 27' must enable the rotation of the counter supporting means 27' about a predetermined angle.

According to the embodiment illustrated in FIGS. 6 to 13, a supporting means 56 and a counter supporting means 57 is each arranged between the cover plate 23 of a housing 24 enclosing the cylinder portion 21 of the pressure medium cylinder and a plate 55 located opposite this cover plate 23 and articulately connected to the end of the piston rod 22 or to the displaceable framework part 9, enabling the displaceable framework part 9 to be positioned at several precisely defined distances relative to the stationary framework part 7 such that the distance 25 of the oppositely located strand guideways 12, 13 and hence the thickness of the strand 1 to be cast are variable.

Each supporting means 56 is comprised of three concentrically superimposed supporting discs 58, 59, 60 slipped on a bushing 61 surrounding the piston rod 22. The supporting discs 58, 59, 60 have recesses 63 located centrically with respect to their central axes 62, which are designed as segment-shaped throughholes in the embodiment illustrated. The supporting discs 58, 59, 60 are rotatable relative to one another, a separate pressure-medium cylinder 64, 65, 66 being provided to realize the rotational movements for each of the supporting discs 58, 59, 60. Each of these pressure medium cylinders 64, 65, 66 engages at a radial extension 67 of one of the supporting discs and is countermounted on the cover plate 23. The supporting discs 58, 59, 60 may be rotated by aid of these pressure-medium cylinders as will be explained in more detail later on by way of FIGS. 10 to 13.

As is apparent from FIG. 9, each of the supporting discs 58, 59, 60 externally is provided with a collar 68 projecting into a peripherally extending groove 69 of the supporting disc or of the cover plate 23, respectively, arranged therebelow so as to provide for a protection towards outside.

The supporting discs themselves are each provided with a coating 70 to reduce friction. For an improved guidance of the supporting discs 58, 59, 60, laterally rising guide ledges 71 are provided on the cover plate 23, reaching as far as to the uppermost supporting disc 58 and uniformly distributed about their circumference. An annular bead 72, which overlaps the uppermost supporting disc 58 is mounted to the upper end of this guide ledge 71 such that the supporting discs 58, 59, 60 are held together. These guide ledges project into circumferential recesses 73 of the supporting discs 58, 59, 60 such that the course of the rotational movement of each supporting disc 58, 59, 60 is limited by stops 74, 75, i.e., the end faces of the circumferential grooves, cooperating with the guide ledges 71.

A counter supporting disc 76 is arranged above each supporting disc 58, 59, 60 and is liftable and lowerable with the upper framework part 9 by being carried by the bushing 61, on which it is supportable on a shoulder 77. Each of these counter supporting discs 76 comprises projections 78 extending in the direction of its central axis and having cross sections corresponding to the cross sections of the recesses 63 of the supporting discs 58, 59, 60, yet reduced by a slight lateral play 79. These projections 78 are insertable into the recesses of the supporting discs as these recesses 63 are turned into positions registering with the projections 78. The length 80 of each projection 78 is dimensioned to be larger than the sum of the thicknesses of the superimposed supporting discs 58, 59, 60.

The front faces of the ends of the projections 78 constitute counter supporting surfaces 81 resting either on the cover plate 23 or on one of the supporting discs 58, 59, 60 between the recesses 63 of the same, which intermediate pieces will serve as supporting surfaces 82 to the projections 78. Each counter supporting disc 76 externally is surrounded by a telescopic cylinder 83 in a manner that the penetration of impurities to the supporting means 56 and the counter supporting mean 57 is prevented.

With the embodiment illustrated, three supporting discs 58, 59, 60 are provided, thus offering a total of four different distance adjustments of the oppositely located supporting rollers 2, 3. The number of supporting discs may be chosen according to demands.

From FIGS. 7 and 8 it is apparent that six recesses 63 are provided per supporting disc 58, 59, 60, from which an angle of adjustment 84 of 30° results for each supporting disc 58, 59, 60. By increasing the number of recesses 63 per supporting disc, the angle of adjustment 84 may be reduced, wherein, however, approximately half of the circularly-arc-shaped cross sections of the supporting discs 58, 50, 60 or counter supporting discs is available as a supporting surface 82 or counter supporting surface 81 in any event, i.e., irrespective of the number of recesses 63, the widths of the circularly-arc-shaped cross sections corresponding to the radial dimensions 85 of the projections 78.

In combination with the rotary bushings 43 having helicoidal supporting surfaces, which are arranged on each pressure-medium cylinder and are not illustrated in FIGS. 6 to 13 for reasons of clarity (the plate 55 being entered instead), the continuous adjustment of the distance of the strand guideways 12, 13 is feasible, wherein it will do if the adjustment course that may be achieved by aid of the bushings having helicoidal supporting surfaces corresponds to the height of a supporting disc 58, 59, 60.

As is apparent from schematic FIGS. 10 to 13, a control valve 86 is each provided to prevent maladjustments of the supporting discs 58, 59, 60, i.e., to prevent a projection 78 from abutting against a supporting surface 82 of a supporting disc 58, 59 that is not supported by the supporting surface 82 of a subjacent supporting disc 59, 60, which control valve actuates the pressure-medium cylinders 64, 65, 66 in a manner that the projections 78 of each counter supporting disc 76 always rest on sandwiched solid material of the supporting discs 58, 59. This control valve 86 consists of an elongate cylinder housing 87, in whose interior a double piston 88 is provided, whose pistons 89 are interconnected by a rod 90. A pressure-medium discharge duct 91 is connected to each end of the cylinder housing 87; a pressure-medium supply duct 92 is provided in the middle of the longitudinal extension of the cylinder housing. The two pistons 89 are arranged at a distance that is slightly larger than the respective distance between discharge duct 91 and supply duct 92.

Feeding of the pressure-medium cylinders 64, 65, 66 is effected via six supply ducts 93, 94, three (93) of which supply ducts joining one end of the pressure-medium cylinders 64, 65, 66 empty into the cylinder housing 87 between the first discharge duct 91 and the central supply duct 92 and three other (94) of which supply ducts joining the other end of the pressure-medium cylinders 64, 65, 66 empty into the cylinder housing between the second discharge duct 91 and the central supply duct 92. The two pistons 89, which are displaceable within the cylinder housing 87, have a thickness that is slighter than the distance between the mouths of the individual supply ducts 93, 94. The feed duct 92 alway is within the space enclosed by the pistons 89. The control of the double piston 88 may be effected manually or electronically from the control platform of the continuous casting plant.

As is apparent from FIGS. 10 to 13, the pressure-medium cylinders 64, 65, 66, by means of the control valve 86, may be supplied with pressure medium only in a manner that the projections 78 always rest on solid material formed by the supporting discs 58, 59, 60 above the cover plate 23 such that any deformation of the supporting discs 58, 59 due to the compression pressure applied by the pressure medium cylinders 17 via the projections 78 is prevented.

What we claim is:

1. In a strand guide arrangement provided at a continuous casting plant and of the type including oppositely arranged framework parts carrying oppositely located strand guiding rollers, a guiding means, a displacement means for displacing at least one of said framework parts along said guiding means by widening or narrowing the distance of said oppositely located strand guiding rollers supporting means having supporting surfaces provided at different height levels and counter supporting means having counter supporting surfaces, said framework parts being clampable relative to each other by said displacement means until abutment of said supporting means on said counter supporting means, the improvement comprising a rotary bushing including a helicoidal supporting surface and arranged in series to each supporting and counter supporting means between said framework parts, and an abutment allocated to one of said framework parts and supported on said helicoidal supporting surface.

2. A strand guide arrangement as set forth in claim 1, wherein said abutment is comprised of an irrotational bushing having a helicoidal supporting surface, said irrotational bushing and said rotational bushing abutting against each other by their helicoidal supporting surfaces.

3. A strand guide arrangement as set forth in claim 1, wherein said displacement means is comprised of a tension rod adapted to connect said oppositely arranged framework parts, said supporting and counter supporting means, said rotary bushing as well as said abutment means being arranged centrically with respect to said tension rod.

4. A strand guide arrangement as set forth in claim 3, wherein said framework parts, in the top view, are designed as rectangular frames in whose corners a tension rod is each arranged.

5. A strand guide arrangement as set forth in claim 4, wherein said tension rod is designed as a pressure-medium cylinder comprising a cylinder articulately connected to one of said framework parts and a piston rod articulately connected to the other of said framework parts, said piston rod passing through said supporting and counter supporting means.

6. A strand guide arrangement as set forth in claim 1, wherein said guiding means is provided on one of said framework parts for guidance of the other of said framework parts laterally therealong in a manner perpendicular to the direction of displacement, said guiding means allowing for pivotal movements of said framework parts relative to each other about an axis extending parallel to said strand guiding rollers.

7. A strand guide arrangement as set forth in claim 6, wherein said guide means is comprised of a guiding column rigidly arranged on one of said framework parts and comprising camfered supporting surfaces projecting laterally from said guiding column, guiding surfaces being provided on the other of said framework parts so as to contact said camfered supporting surfaces.

8. A strand guide arrangement as set forth in claim 7, wherein said camfered supporting surfaces are designed to be cylindrical.

9. A strand guide arrangement as set forth in claim 5, comprising a plurality of rotary bushings and a plurality of pressure-medium cylinders and wherein said rotary bushings provided on said pressure medium cylinders arranged in equal positions in the longitudinal direction of said strand guide arrangement are actuatable synchronously and independently of said rotary bushings provided on said pressure medium cylinders arranged in other positions in the longitudinal direction of said strand guide arrangement.

10. In a strand guide arrangement provided at a continuous casting plant and of the type including oppositely arranged framework part carrying oppositely located strand guiding rollers, a guiding means and a displacement means adapted to displace at least one of said framework parts along said guiding means by widening or narrowing the distance of said oppositely located strand guiding rollers, said displacement means being comprised of a tension rod connecting said oppositely arranged framework parts and designed as a pressure-medium cylinder including a piston rod, supporting means having supporting surfaces provided at different height levels and counter supporting means having counter supporting surfaces, said framework parts being clampable relative to each other by said displacement means until abutment of said supporting means on said counter supporting means, a rotary bushing including a helicoidal supporting surface and arranged in series to each supporting and counter supporting means between said framework parts, and an abutment allocated to one of said framework parts and supported on said helicoidal supporting surface, the improvement wherein said supporting and counter supporting means are designed as disc means surrounding said piston rod of said pressure medium cylinder, one of said supporting or counter supporting means is rotatable relative to said piston rod, projections are provided on one of said supporting or counter supporting means, recesses are provided in one of said supporting or counter supporting means for receiving said projections, said projections, by rotation of said supporting or counter supporting means, being one of insertable into said recesses and placeable on said projections provided between said recesses.

11. A strand guide arrangement as set forth in claim 10, wherein one of projections and recesses are provided in several height levels per supporting and counter supporting means.

12. A strand guide arrangement as set forth in claim 10, wherein at least two supporting and counter supporting means are provided per tension rod.

13. A strand guide arrangement as set forth in claim 3 or 10, wherein a supporting and counter supporting means, together with a rotary bushing and its abutment, constitute a structural unit capable of being slipped on said tension rod.

14. A strand guide arrangement as set forth in claim 13, further comprising a protection means designed as a telescopic cylinder and surrounding said structural unit externally.

15. A strand guide arrangement as set forth in claim 1 or 10, wherein said helicoidal supporting surface of said rotary bushing has an angle of inclination smaller than the angle of friction pertaining to the friction prevailing between said rotary bushing and said abutment.

16. In a strand guide arrangement provided at a continuous casting plant and of the type including oppositely arranged framework parts carrying oppositely located strand guiding rollers, a guiding means, a displacement means for displacing at least one of said framework parts along said guiding means by widening or narrowing the distance of said oppositely located strand guiding rollers, supporting means having supporting surfaces provided at different height levels and counter supporting means having counter supporting surfaces, said framework parts being clampable relative to each other by said displacement means until abutment of said supporting means on said counter supporting means, a rotary bushing including a helicoidal supporting surface and arranged in series to each supporting and counter supporting means between said framework parts, and an abutment allocated to one of said framework parts and supported on said helicoidal supporting surface, the improvement wherein said supporting and counter supporting means are designed as supporting and counter supporting discs having disc central axes and being superimposed in alignment with respect to said disc central axes, said disc central axes being oriented parallel to said guiding means, at least two superimposed concentric supporting discs and a single counter supporting disc are arranged on each side of said framework parts that is allocated to an end of a strand guiding roller, recesses are provided in said supporting discs so as to extend centrically with respect to said disc central axes, projections are provided on each counter supporting disc in a manner extending in the direction of its disc central axis and are introducible into said recesses of said supporting discs, the length of each of said projections being dimensioned to be larger than the thickness of the at least one supporting disc located above the lowermost of said supporting discs, and adjustment means are provided for rotating said supporting discs about said disc central axes by a predetermined angle into a position in which said recesses of said superimposed supporting discs are in alignment with said projections of said counter supporting disc as well as into a position in which said recesses of at least one supporting disc come to lie laterally of said projections.

17. A strand guide arrangement as set forth in claim 16, wherein said recesses of said supporting discs are designed as segment-shaped holes and said projections of said counter supporting disc have corresponding cross sections reduced by a lateral play.

18. A strand guide arrangement as set forth in claim 16, wherein each of said projections of said counter supporting disc has a length dimensioned to be larger by a play than the sum of the thicknesses of said supporting discs alignedly arranged to a stack.

19. A strand guide arrangement as set forth in claim 16, further comprising a guide ledge arranged on each of said supporting discs on the external circumference thereof so as to extend parallel to its disc central axis and over the height formed by said supporting discs alignedly arranged in a stack, and a stop provided on each of said supporting discs and adapted to cooperate with said guide ledge with a view to limiting the rotational movement of said supporting disc.

20. A strand guide arrangement as set forth in claim 16, further comprising a separate pressure-medium cylinder provided for each of said superimposed supporting discs for rotation thereof.

21. A strand guide arrangement as set forth in claim 16, further comprising an annular groove externally provided on each of said supporting discs and a circumferential web, said annular groove receiving said circumferential web of the respective supporting disc arranged thereabove or therebelow.

22. A strand guide arrangement as set forth in claim 19, further comprising a peripheral annular bead provided on said guide ledge on its end facing the uppermost of said supporting discs so as to overlap the uppermost of said supporting discs.

23. A strand guide arrangement as set forth in claim 16, wherein said displacement means is comprised of a tension rod connecting said oppositely arranged framework parts and said supporting and counter supporting discs each are arranged centrically with respect to said tension rod.

24. A strand guide arrangement as set forth in claim 20, further comprising a control valve provided for controlling said pressure-medium cylinders of said supporting discs superimposed to a stack in a manner that said projections of said counter supporting disc rest on sandwiched solid material of said supporting discs.

* * * * *